US005735785A

United States Patent [19]

Lucas et al.

[11] Patent Number: 5,735,785

[45] Date of Patent: Apr. 7, 1998

[54] APPARATUS AND METHOD FOR FORMING CARTON BLANKS

[75] Inventors: Philip J. Lucas, Lakewood; Gerald P. Leffler, Arvada, both of Colo.

[73] Assignee: Graphic Packaging Corporation, Paoli, Pa.

[21] Appl. No.: 684,295

[22] Filed: Jul. 18, 1996

[51] Int. Cl.[6] ..... B65H 23/04; B26D 5/34

[52] U.S. Cl. ..... 493/34; 83/371

[58] Field of Search ..... 493/3, 6, 8, 9, 493/10, 11, 19, 22, 24, 29, 61, 62, 228, 355, 417; 83/371, 732, 436

[56] References Cited

U.S. PATENT DOCUMENTS

| | | | |
|---|---|---|---|
| 4,692,799 | 9/1987 | Saitoh et al. | 358/106 |
| 4,888,717 | 12/1989 | Ditto et al. | 364/559 |
| 5,470,300 | 11/1995 | Terranova | 493/29 |

*Primary Examiner*—Joseph J. Hail, III
*Assistant Examiner*—Anthony Ojini
*Attorney, Agent, or Firm*—Klaas, Law, O'Meara & Malkin, P.C.; Joseph J. Kelly

[57] ABSTRACT

Apparatus and method for locating a portion of a continuous web of material having graphics printed thereon at a correct location in a cutting and creasing machine for forming carton blanks by comparing the location of a section of the graphics on a portion of the continuous web with a preset location of where the section of graphics should be and generating a control signal for moving the portion in vector and parallel paths to the correct location in the cutting and creasing machine. The continuous web is moved by applying a force on opposite sides of the center line of the continuous web along a linear line wherein the linear lines are located so that the included angle between the linear lines in the direction of movement of the continuous web is less than 180 degrees. Also, the linear lines can be located so that the included angle between each linear line and the center line of the continuous web in the direction of movement of the continuous web is less than 90 degrees.

20 Claims, 8 Drawing Sheets

APPARATUS AND METHOD FOR FORMING CARTON BLANKS

FIELD OF THE INVENTION

This invention relates generally to the formation of carton blanks and more particularly to the movement of the continuous web of material from which the carton blanks are formed so that a portion of the continuous web is at a correct location in a cutting and creasing machine.

BACKGROUND OF THE INVENTION

In the manufacture of carton blanks from a continuous web of material having graphics printed thereon, it is essential that a portion of the continuous web of material is at a correct location in a cutting and creasing machine so that the graphics will be properly oriented in the carton blank formed in the cutting and creasing machine from the continuous web of material. There have been many systems suggested for obtaining the desired result of the positioning of a portion of the continuous web of material at the correct location in the cutting and creasing machine. One such system is described in the U.S. patent application Ser. No. 08/105,071 filed Aug. 10, 1993 (now abandoned) which application is incorporated herein by reference thereto. However, there still exists a need for an efficiently operating system that will move a portion of a continuous web of material having graphics printed thereon into a correct location in a cutting and creasing machine so that the carton blank formed thereby will have the graphics properly positioned.

BRIEF DESCRIPTION OF THE INVENTION

This application provides apparatus and method for positioning a portion of a continuous web of material having graphics printed at a correct location in a cutting and creasing machine wherein a portion of such a continuous web is moved into a control station whereat the location of a section, which section is preferably rectangular in shape, of the graphics thereon is compared with a preset location of where the graphics should be located and a control signal is generated that is indicative of any deviation of the location of the section of graphics from the preset location of the section of graphics. The portion of the continuous web is first moved along a vector path relative to the center line of the cutting and creasing machine, which vector path is determined by the control signal, by applying forces to the continuous web of material along linear lines on opposite sides of the center line of the continuous web of material and is then moved along a path parallel to the center line of the cutting and creasing machine.

In a preferred embodiment of the invention, the apparatus for accomplishing the foregoing results includes a cutting and creasing machine for making cut and fold lines in successive portions of a continuous web of material having graphics printed thereon to form a carton blank, which cutting and creasing machine is mounted at a fixed location and a control station through which the continuous web of material is passed and which control station is located adjacent to the cutting and creasing machine. Moving means are provided for moving a portion of the continuous web of material into the control station. The control station has orientation means located therein for comparing the location of a section of the graphics printed on a portion of the continuous web of material with a preset location of where the section of graphics should be located and for generating a control signal indicating any deviation of the location of the section of graphics from the preset location of the section of graphics. The moving means also moves the portion of the continuous web of material from the control station into the cutting and creasing machine. Control means are provided and operate in response to the control signal to operate the moving means to move the portion of the continuous web of material into a correct location in the cutting and creasing machine so that the graphics are properly located in the formed carton blank. As stated above, the section is preferably rectangular in shape. However, the section can be of other configurations.

The moving means include at least two spaced apart drive rolls and at least two spaced apart idler rolls which apply a moving force on the portion of the continuous web of material located between the at least two spaced drive rolls and the at least two spaced apart idler rolls. Each of the at least two spaced apart idler rolls has an axis of rotation that is parallel to the axis of rotation of an associated one of the at least two spaced apart drive rolls. In the preferred operation of the invention, the axes of rotation of one of the at least two spaced apart drive rolls and its associated one of the at least two spaced apart idler rolls are out of alignment with the axes of rotation of the other one of the at least two spaced apart drive rolls and its associated other one of the at least two spaced apart idler rolls. At least two spaced apart variable speed drive means are provided and each of them rotates one of the at least two spaced apart drive rolls.

A support frame is located at a relatively fixed position at the control station and has a center line in alignment with the center line of the cutting and creasing machine. The continuous web of material has a center line which is parallel to the center line of the cutting and creasing machine as the continuous web of material is moved into the desired location in the cutting and creasing machine. The at least two spaced apart drive rolls are located so that the included angle between the axis of rotation of one of the at least two spaced apart drive rolls and the axis of rotation of the other of the at least two spaced apart drive rolls in relation to the center line of the support frame is less than 180 degrees. In one preferred embodiment of the invention, the included angle between the axis of rotation of the one of the at least two spaced apart drive rolls and the center line of the support frame in the direction of movement of the continuous web of material is less than 90 degrees and the included angle between the axis of rotation of the other one of the at least two spaced apart drive rolls and the center line of the support frame in the direction of movement of the continuous web of material is less than 90 degrees. The control signal generated by the orientation means comprises the distance that the location of the section of the graphics on the portion of the continuous web of material is off set from the preset location of the section of graphics in directions parallel and perpendicular to the center line of the support frame and the generated control signal moves the drive means to move the portion of the continuous web of material first along a vector path determined therefrom and then along a path parallel to the center line of the support frame and the cutting and creasing machine. Also, the orientation means are mounted for movement in directions parallel and perpendicular to the center line of the support frame to locate the orientation means at a desired location.

In a preferred embodiment of the invention, two spaced apart mounting plates are pivotally mounted on the support frame. Each of the two spaced apart mounting plates has one of the at least two spaced apart drive rolls, one of the at least two spaced apart idler rolls and one of the at least two variable speed drive means mounted thereon for movement therewith. Adjusting means are provided for pivotally adjusting each of the two spaced apart mounting plates. Each of the at least two spaced apart variable speed drive means comprises a variable speed motor, a first rotatable pulley mounted on and rotated by the variable speed motor, a second rotatable pulley mounted on the drive roll to rotate the drive roll and a driving belt journaled around the first and second rotatable pulleys moved by the first rotatable pulley to rotate the second rotatable pulley. Each variable speed motor is mounted on a support plate which is mounted for linear movement over one of the two spaced apart mounting plates. Adjusting means are provided for moving the support plate to adjust the tension in the driving belt.

In a preferred embodiment of the invention, a method is provided for moving a portion of a continuous web of material having graphics printed thereon into a cutting and creasing machine for forming carton blanks from the continuous web of material by moving a portion of the continuous web of material into a control station having orientation means located therein, comparing the location of a section of the graphics on the portion of the continuous web of material in the control station with a preset location of where the same section of graphics on the portion of the continuous web of material should be, generating a control signal indicative of the vector path along which the portion of the continuous web of material is to be moved first and then in a second path parallel to the machine direction of movement of the center line of the cutting and creasing machine so that the section of the continuous web of material is positioned at the correct location in the cutting and creasing machine and moving the portion of the continuous web of material along the vector and parallel paths until the portion of the continuous web of material is at the correct location in the cutting and creasing machine. The method further comprises applying mowing forces on the continuous web of material on opposite sides of a center line of the continuous web of material to move the portion of the continuous web of material along the vector and parallel paths. The method further comprises applying each of the applied forces to extend along a linear line of each side of the center line and locating the linear lines so that the including angle of the linear lines in the direction of movement of the continuous web of material is less than 180 degrees and preferably locating the linear lines so that the included angle between each of the linear lines and the center line of the continuous web of material is less than 90 degrees. Also, the method may comprise applying a greater amount of force upon one of the linear lines than the amount of force applied to the other one of the linear lines.

In operation of the apparatus, a portion of a continuous web of material is moved into the control station. The orientation means compares the location of a section of the graphics on the portion with a preset location of where that section should be and generates a control signal indicative of the vector and parallel paths along which the portion of the continuous web of material is to be moved so that the portion of the continuous web of material is positioned at the correct location in the cutting and creasing machine so that the graphics on the produced carton blank will be properly located. The control signal rotates each of the at least two spaced apart drive rolls so that the appropriate force is applied to the continuous web of material between each drive roll and its associated idler roll so that the proper amount of force is applied to the continuous web of material on the opposite sides thereof in relation to its centerline to move the portion of the continuous web of material along the vector and parallel paths until it is at the correct location in the cutting and creasing machine so that the graphics on the carton blank formed by the cutting and creasing machine are properly located.

BRIEF DESCRIPTION OF THE DRAWINGS

An illustrative and presently preferred embodiment of the invention is illustrated in the drawing in which.

DETAILED DESCRIPTION OF THE INVENTION

Figure 1:
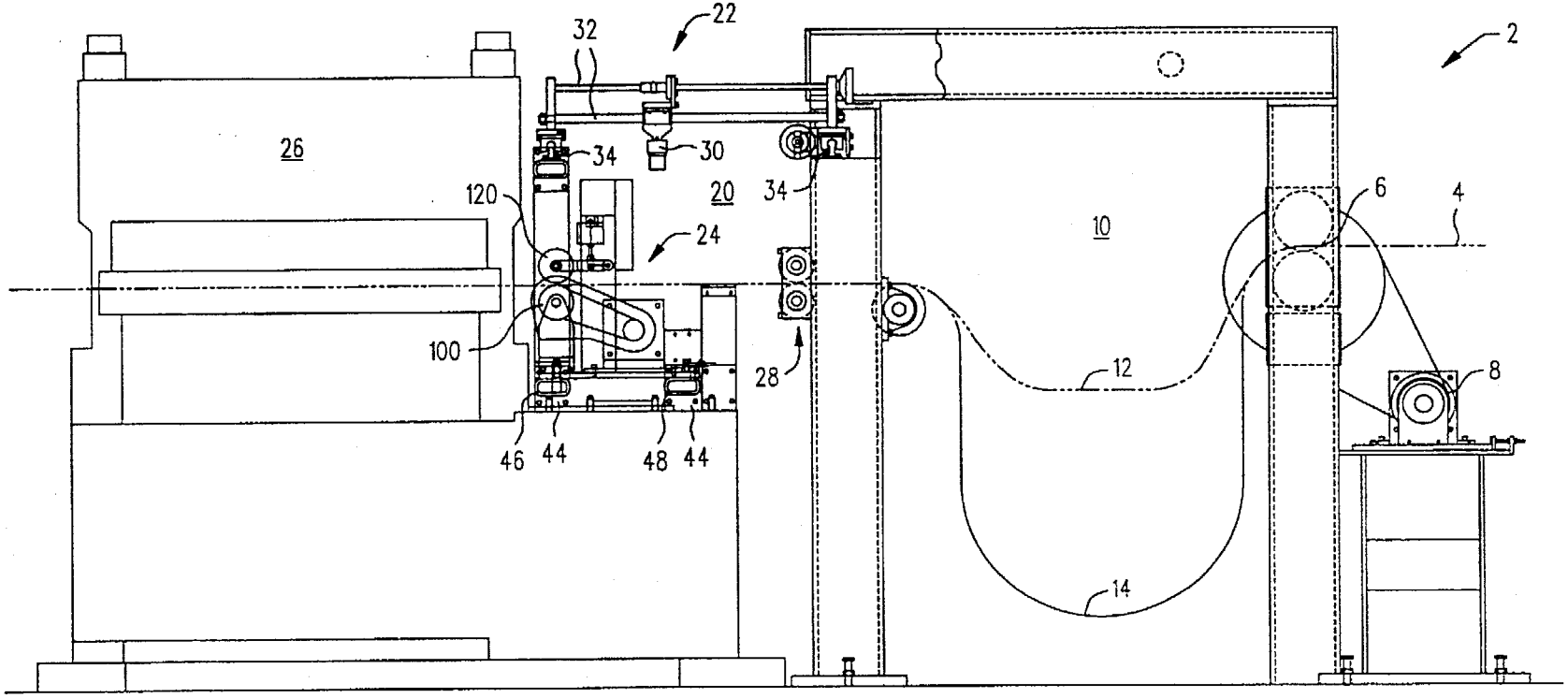
FIG. 1 is a schematic side elevational view of the apparatus of this invention.

In FIG. 1 there is illustrated various stations of the apparatus 2 of this invention. A continuous web 4 of preprinted carton blank material is continuously fed by feed rolls 6 rotated by drive means 8 into a supply station 10. The dashed line 12 in the supply station 10 indicates the least amount of the continuous web 4 in the supply station 10 and the solid line 14 indicates the most amount of the continuous web 4 in the supply station 10.

Adjacent to the supply station 10 is a control station 20. Orientation means 22 and moving means 24 are located in the control station 20 and are described more fully below. A conventional cutting and creasing machine 26 is located adjacent to the control station 20 and functions to form cut lines and fold lines in the continuous web 4 and to cut the continuous web 4 into desired carton blanks. Guide rolls 28 guide the movement of the continuous web 4 into the control station 20.

The orientation means 22 comprise a vision machine 30 that is mounted on the rails 32 for movement in the machine direction and on the rails 34 for movement in the cross-machine direction. The vision machine 30 is programmed to find a certain section of the graphics preprinted on the continuous web 4 and to compare the actual location of that certain section with the preset location of where that certain section should be. The orientation means 22 then generates a control signal that is fed to the moving means 24 to move the continuous web 4 so that the certain section is located at the proper location in the cutting and creasing machine 26 as described below. The orientation means 22 can be similar to the type shown and described in the '071 application.

Figure 5:
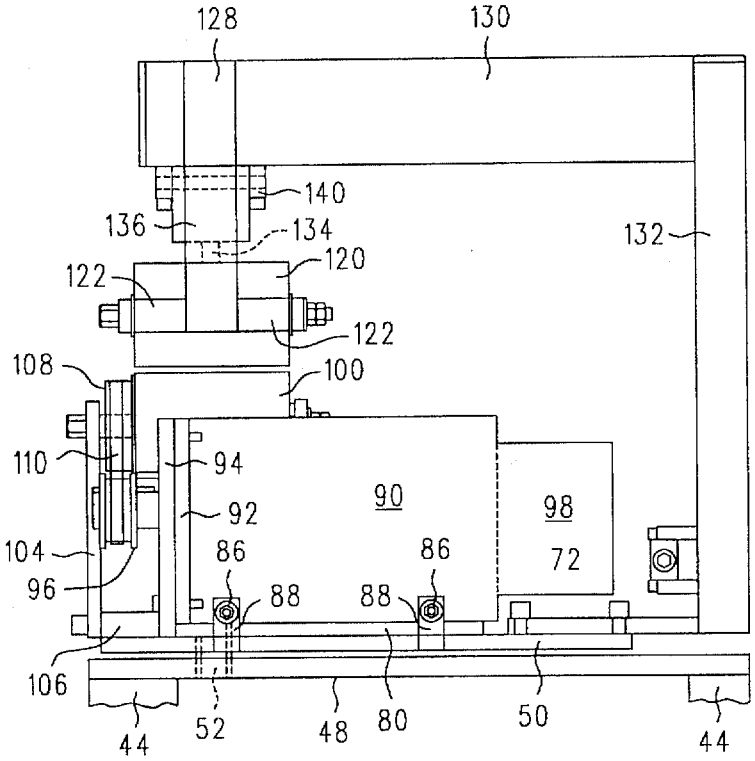
FIG. 5 is a partial front elevational view taken from the bottom right side of FIG. 4.
Figure 6:
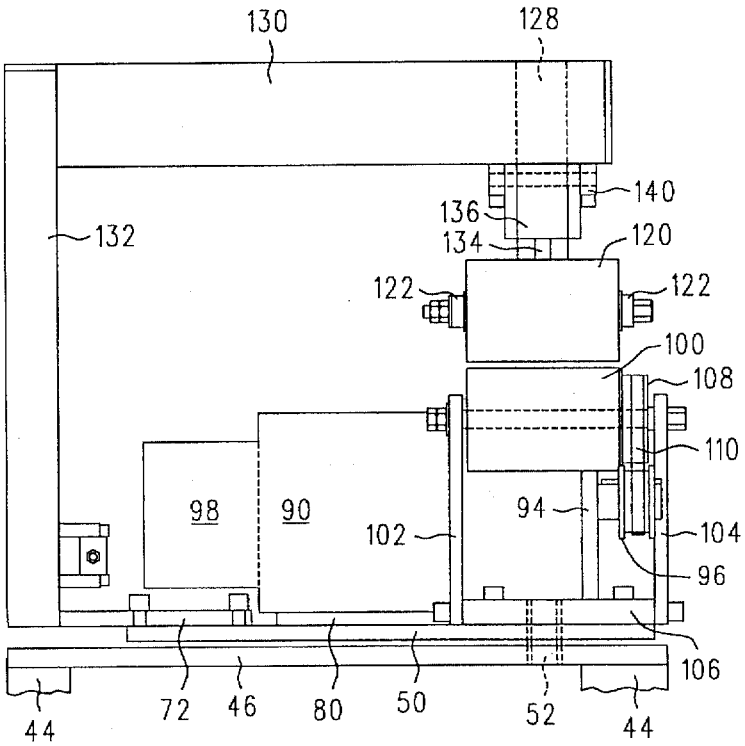
FIG. 6 is a back elevational view of FIG. 5.
Figure 8:
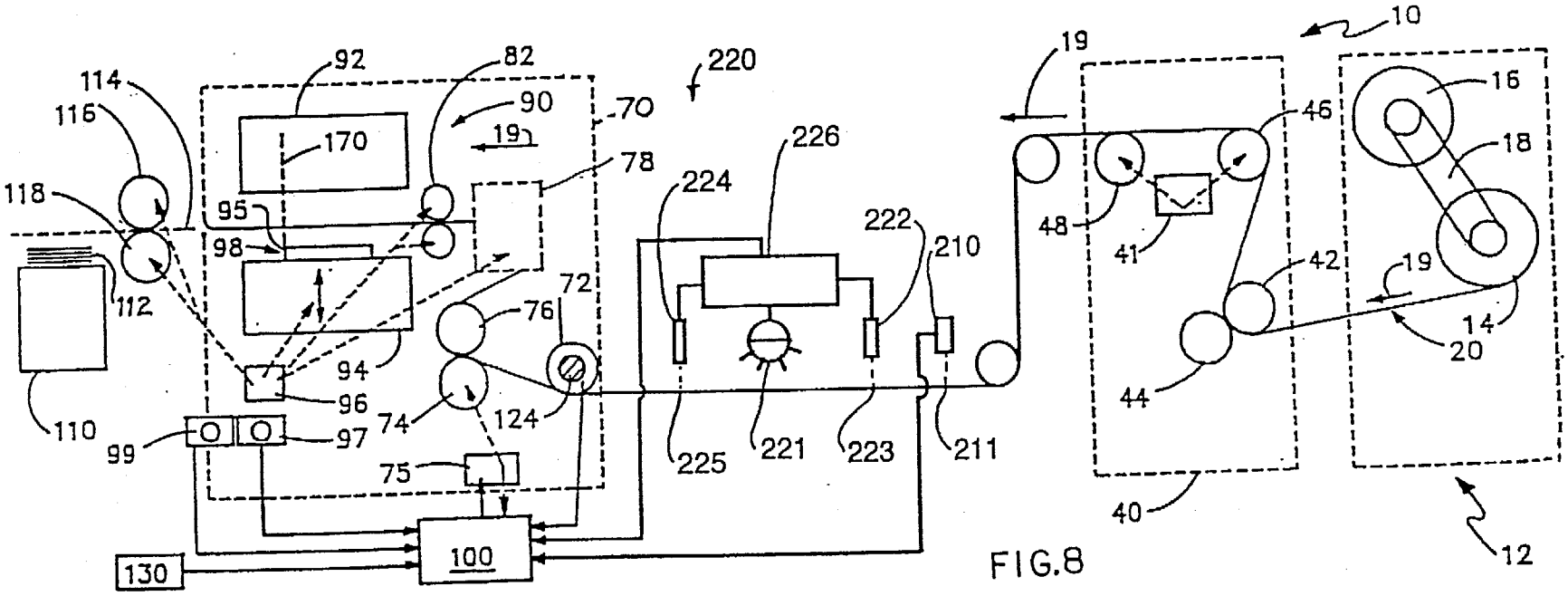
FIG.8 (PRIOR ART)
FIG. 8 is a schematic illustration of a continuous web processing apparatus having a web image bared control system.
Figure 9:
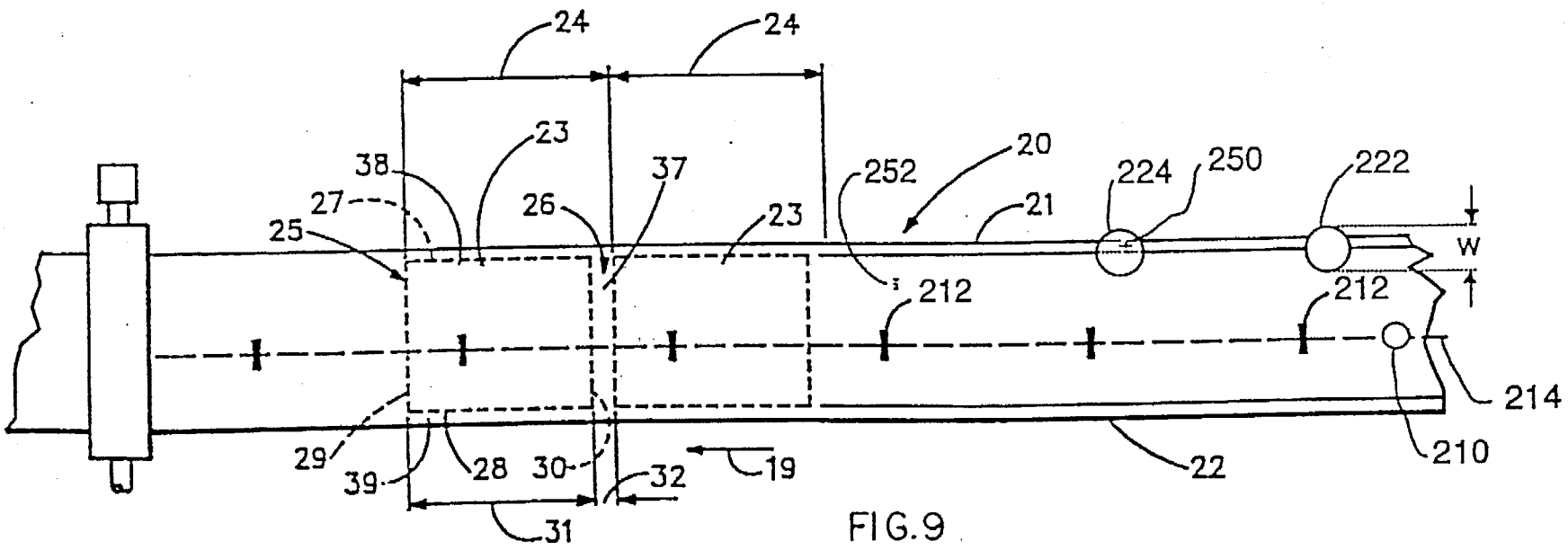
FIG. 9 (PRIOR ART)
FIG. 9 is a plan view of a portion of the web processing apparatus of FIG. 8.
Figure 10:
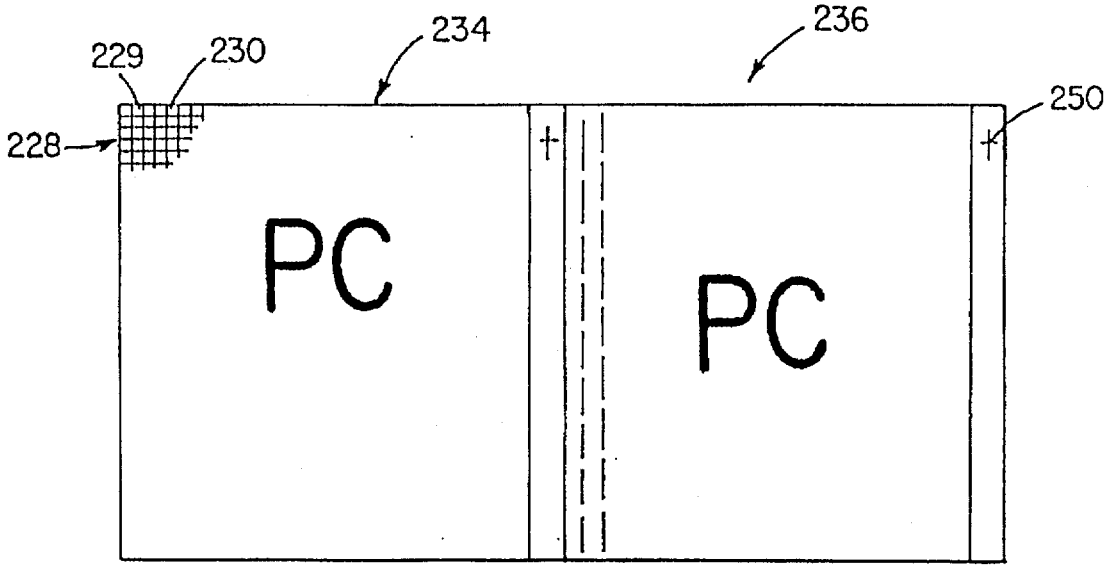
FIG.10 (PRIOR ART)
FIG. 10 is a plan view of an optoelectric image conversion device having images of two spaced apart portions of a web focused thereon.

As illustrated by FIGS. 8 and 9, corresponding to FIGS. 5 and 6 of the '071 application, code reader 210 is positioned along the web at a station 211 located between the decurl and lateral adjustment unit 40 and the cutter creaser assembly 70. The bar code reader is adapted to recognize bar code marks provided at a fixed location within each repeat length portion of the web. The bar code reader is positioned laterally so as to have its reading path 214 aligned with the bar codes printed on the web. The bar code reader generates a register pulse in response to each register mark which it recognizes. Bar code readers are highly accurate in recognizing bar code type register indicia. However, bar code readers also have inherent circuit delays which result in a delay between the time a bar code mark passes through the sensing station 211, and the time that a sensing pulse is generated. These bar code reader signal sensor delays are typically even longer than the delays associated with a photoeye type sensor unit. In the present invention these delays are not a source of error because the bar code sensing pulses are used only for triggering (gating) a more accurate device as described below.

An imaging assembly 220 is provided along the web, preferably proximate to and slightly downstream from the bar code reader, however the particular location of the bar code reader relative to the imaging assembly need not be precise.

The imaging assembly may comprise an illumination unit 221 such as a strobe light which is switched on for a short duration illumination interval in response to the generation of a bar code mark sensing pulse from the bar code reader 210. The area of illumination on the web includes two imaging stations 223 and 225 described below.

The imaging assembly may also comprise a first fiber optics bundle and distal lens assembly 222 positioned along the web at a first imaging station 223 which is a fixed distance from the bar code reader station 211. The first imaging station may be, but is not necessarily, laterally offset from the bar code reading path 214. The imaging assembly may also comprise a second fiber optics bundle and distal lens assembly 224 positioned along the web at a second imaging station 225 which is a fixed distance downstream from the first imaging station 223 and in longitudinal alignment therewith. The fixed distance between the two imaging stations is preferably one design repeat length, however slight deviations from this distance are tolerable. Split fiber optics bundles, as described above, are sometimes referred to in the industry as a bifurcated coherent fiber optics bundle.

Figure 11:
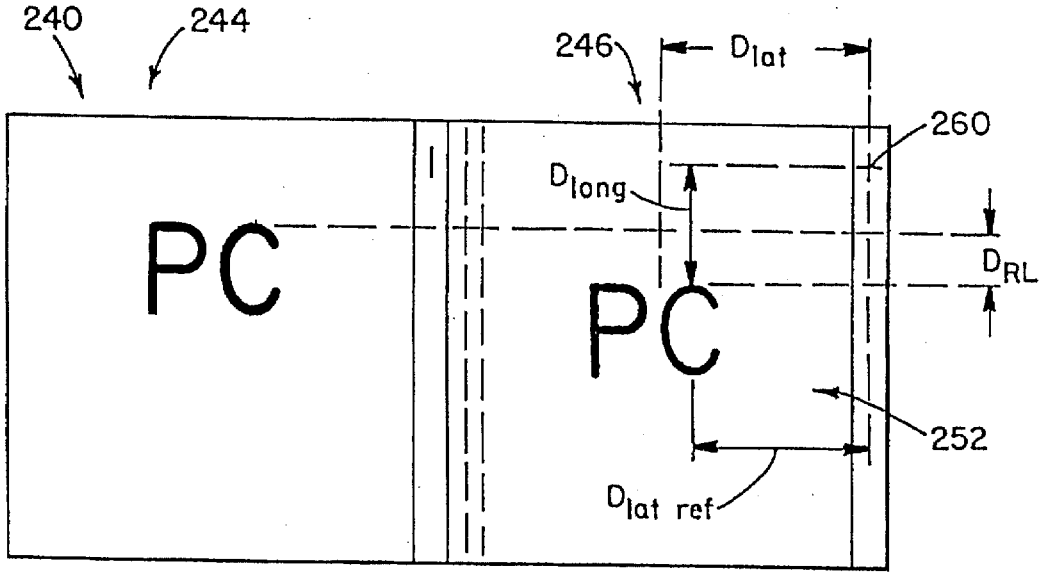
FIG.11 (PRIOR ART)
FIG. 11 is a plan view of an image display screen displaying images generated from the data signal produced by the optoelectric image conversion device of FIG. 10.

Each distal lens assembly and fiber optics bundle 222, 224 produces an optical image of the portion of the web which is currently located at its imaging station 223, 225. The width of the web which is imaged by each of the distal lenses at stations 223 and 225 is dictated at "w" in FIG. 6. The length of the imaged region may be approximately equal to the width. In one embodiment of the invention the image region width is 2 in., and the image region length is 2 in. The optical image is focused by the associated lens on an image plane located within an image converter assembly 226 to which the fiber optics bundles are connected, FIG. 8. A unitary optoelectric converter unit, such as a two dimensional CCD array 228 having multiple pixels 229, 230, etc., is positioned at the image plane and has images from both distal lenses focused thereon simultaneously. The unitary optoelectric converter unit thus produces a single data signal representative of both images which are focused thereon. The data signal produced by the optoelectric converter unit 228 may be used to generate a display of the two portions of the web which were imaged as by providing a split image display on a high resolution display monitor 240 as shown in FIG. 11. Imaging assemblies such as described above are commercially available, for example, from Fostec, Inc., having a business address of 62 Columbus, Auburn, N.Y. 13021. However, to applicant's knowledge such assemblies were, prior to the present invention, used only for quality inspection purposes, not for web control.

In operation when a bar code mark passes below the bar code reader 210 it sends a pulse signal to data processor 100 which actuates the imaging assembly 220 in response thereto. Actuating of imaging assembly 220 causes strobe light 221 to be briefly switched on. At the same time image converter unit 228 is switched on for one operating interval and generates a data signal indicative of the images 234, 236 from the imaging stations which were impinged thereon during that operating interval. This data signal may then be used to produce a split screen display having display image portions 244, 246 corresponding to images 234, 236. The display images 244, 246 or the image data signal itself may then be analyzed to determine certain web control parameters using commercially available image analysis software. FIG. 11 graphically illustrates particular web parameters which are determined.

In performing the image analysis the two display images 244, 246 or the data signal corresponding thereto are initially compared to determine which portions of the two images correspond. Image comparison software is commercially available and well known in the art. The longitudinal distance "$D_{RL}$" i.e. the distance between corresponding portions of the two images 244, 246 in the direction corresponding to the direction of web movement, is then measured. This measured distance represents "repeat length error", i.e. the deviation of the actual length of the subject repeat length portion of the web from the fixed spacing distance between imaging stations 223 and 225. The actual repeat length of the subject web portion may thus be determined by adding $D_{RL}$ to the station spacing distance.

The absolute longitudinal position of the subject repeat length portion of the web is determined by calculating longitudinal registration error "$D_{Long}$". This determination is made by first recognizing a preselected portion of the web graphics 252, which in the illustration of FIG. 11 is the tops of the letters "P" and "C" in the image from the second imaging station 225. The longitudinal distance between this recognized portion of the image and the image 260 of a fixed indicia 250 located adjacent to the web at second image station 225 is then measured. Since the predetermined portion of the web graphics has a known fixed location within each repeat length and since the actual length of the subject repeat length and all preceding repeat lengths have already been determined, it is possible to determine the absolute distance of any portion of the subject repeat length, say its leading edge, from any fixed station along the web downstream from the first imaging station, say the leading edge 170 of the cutter (the distance between the point 170 and the first imaging station 223 being a known, fixed distance).

The relative lateral position of the web may be determined by measuring the lateral distance "$D_{Lat}$" from the image of a recognized web portion, e.g. the left edge of letter "C" in image 244 to the image 260 of second imaging station reference point 250. "$D_{Lat}$" may then be compared to a known value "$D_{Lat\ ref}$" associated with proper web position to determine the error in lateral position, i.e. when the web is tracking properly the left edge of the letter "C" is located at the fixed distance $D_{Lat\ ref}$ from point 260 and thus lateral tracking error may be determined by subtracting $D_{Lat\ ref}$ from $D_{Lat}$.

The manner in which these measured values are used to control web movement will now be described.

In one embodiment the control system achieves proper phasing between web and cutter using the determined repeat length error and longitudinal registration error values in exactly the same manner as the control system described in Ditto, U.S. Pat. No. 4,781,317—the only difference between control systems being the manner in which repeat length error and longitudinal registration error are determined.

Another control system embodiment which is presently the best mode contemplated will now be described with reference to FIG. 12. As described above repeat length error in the repeat length currently positioned between the two imaging stations 223,225 is determined by measuring $D_{RL}$. The speed of the web relative to the speed of the cutter is then adjusted in accordance with the measured value of $D_{RL}$. By way of example if the web "design" repeat length is twenty inches and the measured repeat length error is 0.20 in., then the speed of the web relative to the speed of the cutter would be increased by 1% over the design speed relationship to accommodate the 1% increase in repeat length. Thus, repeat length error is used to control the base speed of the web relative to the base speed of the cutter, typically by adjusting the web speed. This base speed adjustment is preferably performed based upon an average length of several previously determined repeat lengths, for example the preceding four repeat length values.

Next longitudinal registration error in the position of the repeat length currently located at the second image stations 225 is determined. Initially the control system determines what distance the reference portion 252 of the current repeat length should be from the fixed reference indicia 260 at the second imaging station at the occurrence of the next cutter reference pulse (in signal 154). This spacing is referred to herein as the "longitudinal offset distance". This determination is made based upon the measured length of the immediately preceding repeat length portions and the known distance between the second imaging station and the cutter station. For example, where the three previously measured repeat length portions were each twenty inches long, if the station reference indicia 260 is located exactly sixty inches from the point in the cutter station which is designed to be aligned with web indicia 252 at the time a cutter reference pulse is generated, then, for proper phasing, the web register indicia 252 should be located exactly at the station reference indicia 260 when the cutter reference pulse is generated i.e., in this example the "longitudinal offset distance" is O. However, since the subject repeat length is not (except coincidentally) imaged at the same time that a cutter reference pulse is generated it is necessary to measure web travel distance occurring between the time of imaging and the time of the cutter reference pulse in order to determine where the web indicia 252 was located at the time of the cutter reference pulse. Accordingly, if the web traveled 0.01 inch between the cutter reference pulse and the next occurring image trigger pulse then this distance would be subtracted from the measured value $D_{Long}$ to determine the total longitudinal phasing error associated with the current repeat length at image station 223. Thus, by determining the longitudinal offset distance, by measuring $D_{Long}$, and by measuring web travel which occurred between the bar code reader pulse and the nearest (in time) reference pulse from the cutter, the total longitudinal registration error may be determined.

After the total longitudinal phasing error is determined the control system issues a command to temporarily, relatively accelerate or decelerate the web relative to the cutter during the next repeat length of web travel. The amount and duration of this acceleration/deceleration is based upon the total longitudinal phasing error of the previous repeat length portion of the measured repeat length distance of the currently incoming repeat length portion and is selected to place the currently incoming repeat length portion of the web in longitudinal registry with the second imaging station. Any actual error in this process is measured during the next imaging interval and the process is again repeated for the next repeat length, etc.

Figure 12:
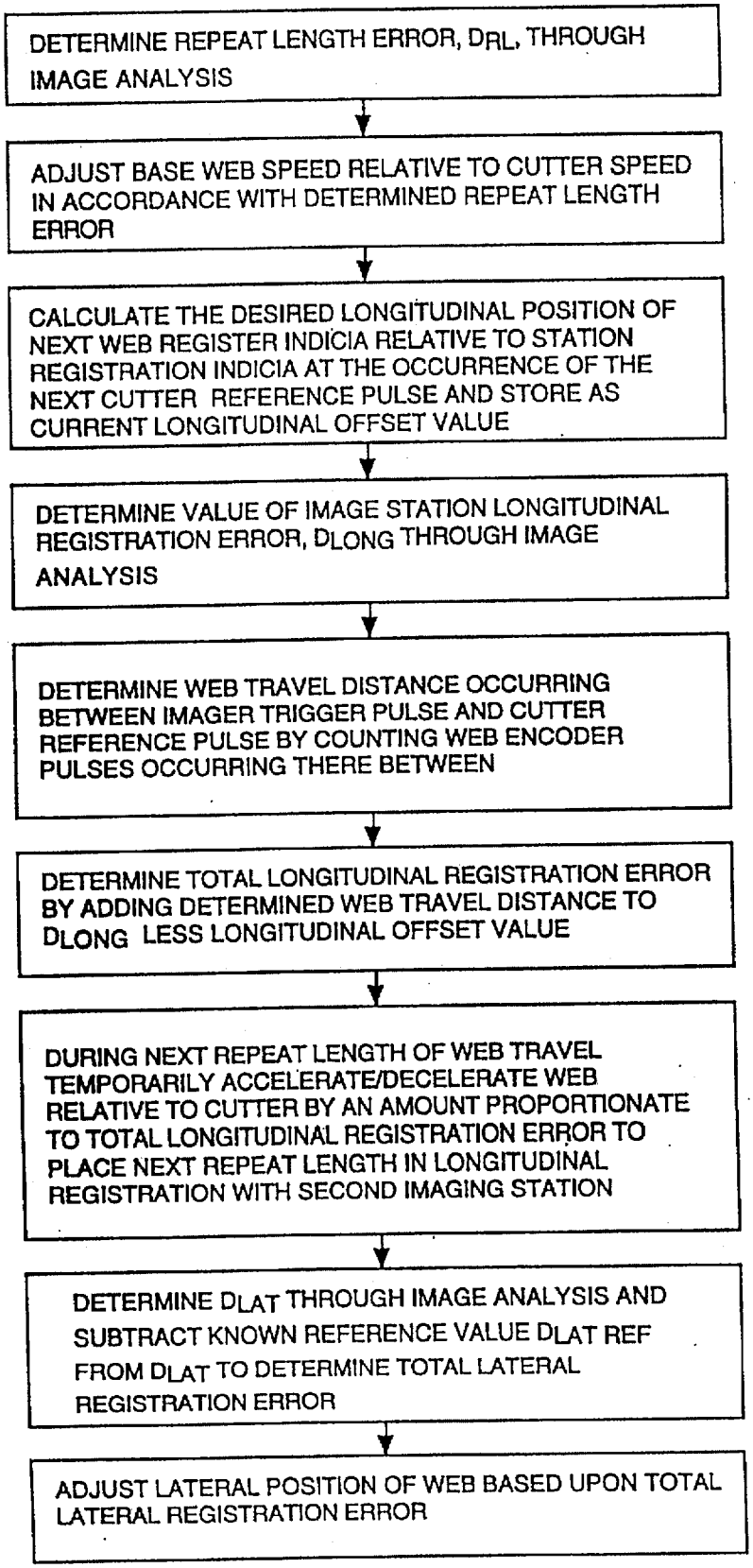
FIG.12 (PRIOR ART)
FIG. 12 is a block diagram showing general processing steps performed by the control assembly of the web processing apparatus of FIG. 5.

Finally, as indicated by the last two blocks in FIG. 12, the lateral position of the web may be monitored and adjusted based upon image analysis to maintain the web in proper lateral position.

Figure 4:
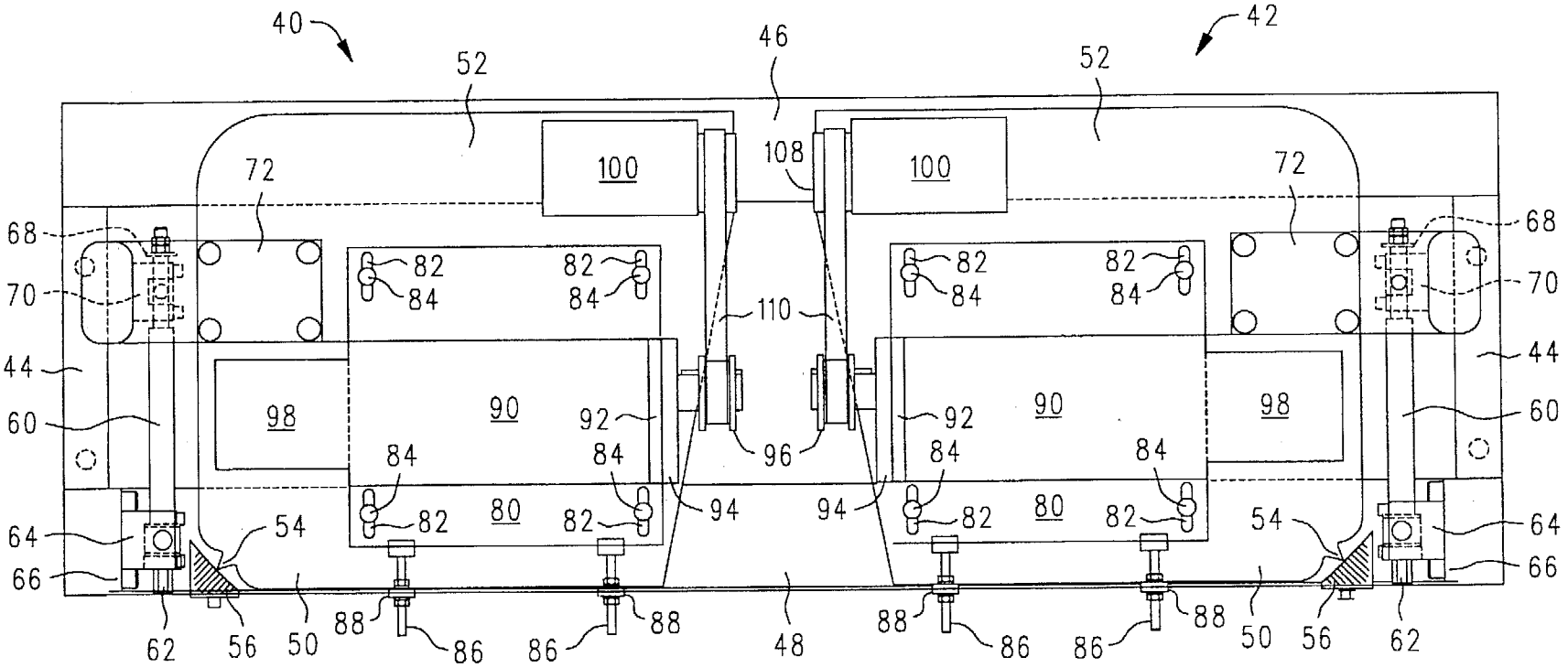
FIG. 4 is a top plan view with parts removed of the moving means of this invention.

The moving means 24 are illustrated in FIGS. 4–7 and are illustrated in FIG. 4 as having a left side 40 and a right side 42. Since each of the left and right sides 40 and 42 have the same components, these components will be identified with the same reference numerals. Each moving means 24 comprises a support frame 44 mounted at a fixed location on which are fixedly mounted support tubes 46 and 48. The support frame 44 and the cutting and creasing machine 26 have aligned or parallel center lines in the direction of movement of the continuous web 4. A mounting plate 50 is supported on the support tubes 46 and 48 for pivotal movement relative thereto around the pivot pin 52, FIGS. 5 and 6, fixedly mounted in the support tube 46. An indicating pointer 54 on the mounting plate 50 and a scale 56 secured to the support tube 48 show the location of the mounting plate 50.

Adjusting means are provided for pivoting each mounting plate 50 and comprise an elongated adjusting bolt 60 having a longitudinal axis. One end 62 of the adjusting bolt 60 is mounted in a pivotal mounting means 64 secured to a support bar 66 fixedly mounted on the support tube 48. The pivotal mounting means 64 allow pivotal and rotatable movement of the one end 64 but prevent longitudinal movement of the one end 62 in either longitudinal direction. The other end 68 of the adjusting bolt 60 is threadly mounted in pivotal mounting means 70 mounted on a plate 72 secured to the mounting plate 50 for movement therewith. Rotation of the elongated adjusting bolt 60 moves the plate 72 to pivot the mounting plate 50 around the pivot pin 52 in either a clockwise or counter-clockwise direction.

A support plate 80 is mounted on the mounting plate 50 for movement thereover in linear directions. A plurality of elongated slots 82 and bolts 84 cooperate to guide the movement of the support plate 80. Adjusting means 86 and 88 secured to the support plate 80 and the support tube 48 function to move the support plate 80 in the linear directions. A variable speed motor 90 is supported on the support plate 80 for movement therewith and has a flange portion 92 that is secured to a support plate 94 secured to the support plate 80. A drive pulley 96 is mounted on the shaft of the variable speed motor 90 which shaft extends through an opening (not shown) in the support plate 94. The variable speed motor 90 may be rotated in a clockwise or a counter clockwise direction and its movement is controlled by control signals received in the control box 98.

As illustrated in FIGS. 4–7, a drive roll 100 is mounted for rotation on a pair of spared apart support posts 102 and 104 mounted on a base plate 106 secured to the mounting plate 50 for movement therewith. A pulley 108 is secured to the drive roll 100. A driving belt 110 is journalled around the drive pulley 96 and the pulley 108 so that rotation of the drive pulley 96 rotates the drive roll 100. The proper tension is placed on the driving belt 110 by the adjustment of the support plate 80.

Figure 7:
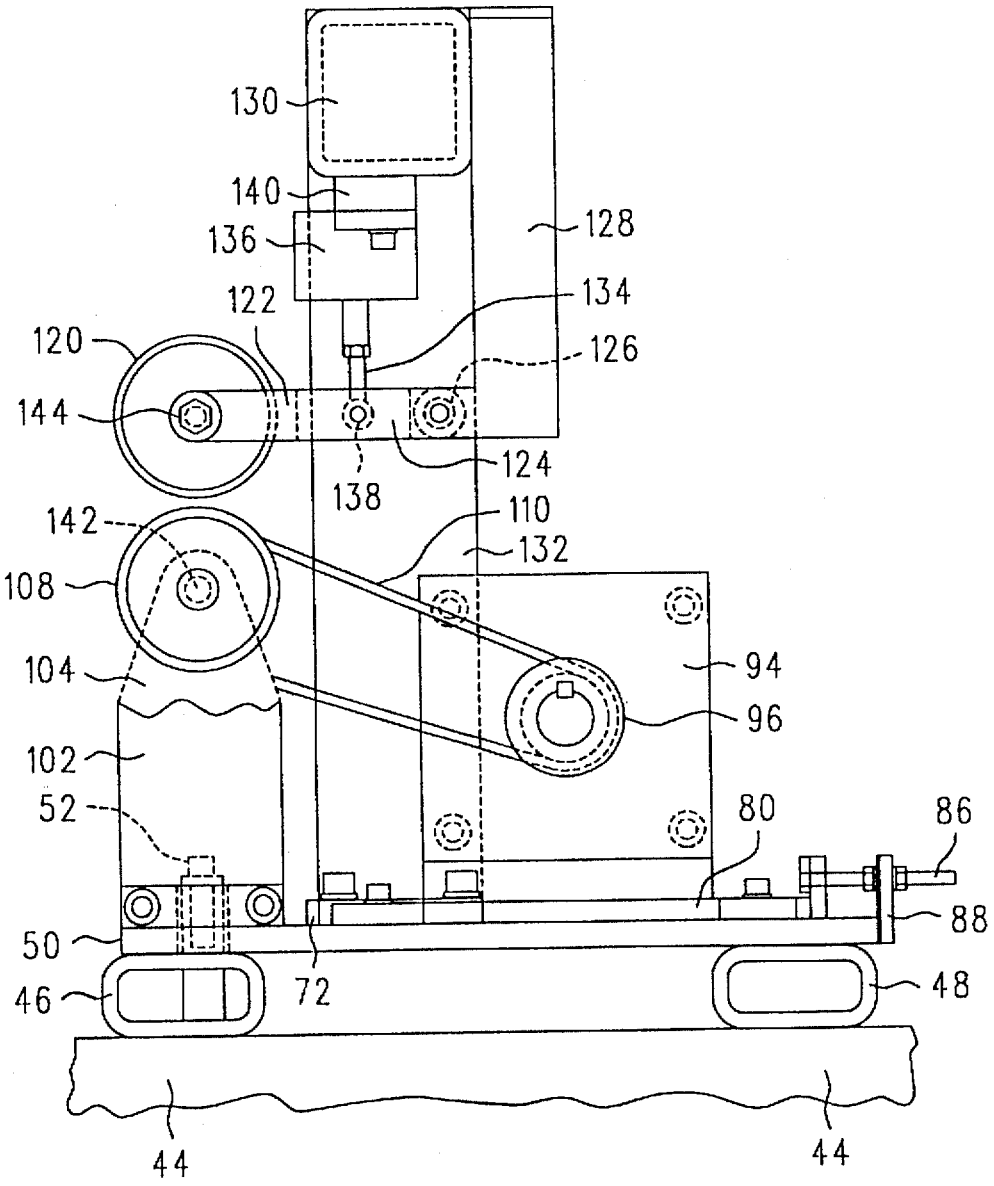
FIG. 7 is a side elevational view of FIG. 5.

As illustrated in FIGS. 5–7, an idler roll 120 is mounted for rotation on bifurcated arms 122 extending outwardly from a support arm 124 pivotally mounted by pivot means 126 fixedly mounted on a fixed support means 128. The support means 128 are secured to a support beam 130 which is fixedly secured to a support post 132 which extends upwardly from and is secured to the plate 72 for movement therewith. The piston rod 134 of an air or hydraulic cylinder 136 is pivotally connected to the support arm 124 by pivot means 138. The air or hydraulic cylinder 136 is pivotally mounted on the support beam 130 by pivot means 140. The air or hydraulic cylinder 136 through the piston rod 134 applies a force on the support arm 124 to urge the idler roll 120 toward the drive roll 100 to apply the desired amount of force on the portion of the continuous web 4 between the drive roll 100 and the idler roll 120. As illustrated in FIG. 7, the axes 142 and 144 of rotation of the drive roll 100 and the idler roll 120 are in a spaced apart, parallel relationship.

Figure 3:
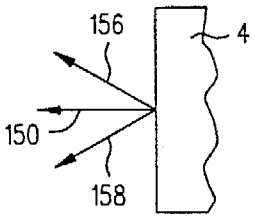
FIG. 3 is a vector diagram to illustrate the movement of a portion of the continuous web of material of this invention.
Figure 2:
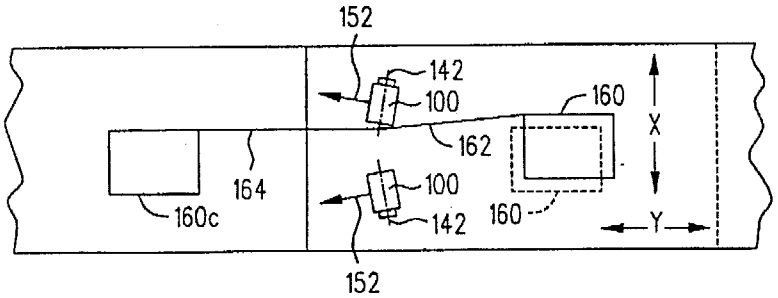
FIG. 2 is a schematic top plan view illustrating the operation of the apparatus of this invention.

The operation of the apparatus 2 is illustrated in FIGS. 1–3. The feed rolls 6 continuously move the continuous web 4 into the supply station 10 so that a portion of the continuous web 4 may be removed by the intermittent operation of the drive rolls 100. The moveable plates 50 are rotated using the adjusting bolts 60 so that the longitudinal axis 142 of each of the drive rolls 100 is inclined relative to the longitudinal axis of the normal movement of the continuous web 4 as indicated by the arrow 150. The drive rolls 100 are preferably inclined to exert a driving force on the continuous web 4 in a direction perpendicular to the longitudinal axis 142 as indicated by the arrows 152 and 154 in FIG. 2. The amount of inclination of the drive rolls 100 is determined by the desired side to side orientation of the drive rolls 100 and the pressure applied by the idler rolls 120 on the portion of the continuous web 4 between the drive rolls 100 and the idler rolls 120 to move the portion of the continuous web 4 from the control station 20 into the correct location in the cutting and creasing machine 26. Preferably, the two spaced apart drive rolls 100, as illustrated in FIG. 2, are located so that the included angle between the axis of rotation of one of the at least two spaced apart drive rolls and the axis of rotation of the other of the at least two spaced apart drive rolls in relation to the center line of the support frame in the direction of movement of the continuous web of material is less than 180 degrees. Also, the included angle between the axis of rotation of the one of the at least two spaced apart drive rolls and the center line of the support frame in the direction of movement of the continuous web of material is less than 90 degrees and the included angle between the axis of rotation of the other of the at least two spaced apart drive rolls and the center line of the support frame in the direction of movement of the continuous web of material is less than 90 degrees. In some instances, the angles of inclination of the drive rolls 100 will be the same and, in other instances, the angles of inclination will be different. Also, the drive rolls 100 can be rotated at the same speed or at different speeds and the pressure applied by the idler rolls 120 can be the same or be different. These parameters are empirically determined in the start-up of the apparatus 2.

As explained below, it is often necessary to move the portion of the continuous web in the control station 20 to its correct location in the cutting and creasing machine 26 in a vector path that differs from the path of the arrow 150 as indicated by the arrows 156 and 158. The actual vector path of such movement will be along an angular vector path between the arrows 150 and 156 or 150 and 158 since the required adjustment of the movement of the continuous web 4 will most probably be very small, such as 0.125 inch, in either direction relative to the center line of the support frame 44.

The determination of the vector path of movement of the portion of the continuous web 4 is illustrated in FIG. 2. The orientation means 30 are programmed so that, if a section 160 of the graphics on the continuous web 4, is located at a preset location, as indicated by the dashed lines, the portion of the continuous web 4 in the control station 20 will be moved along the vector path indicated by the arrow 150 so that the section 160 will be at its correct location in the cutting and creasing machine 26. If the section 160 is not at the preset location, as indicated by the solid lines, the orientation means 30 will move over the rails 32 and 34 until it locates the solid line section 160. The orientation means 30 then generates a signal indicating the location of the orientation means 30 in the x and y directions from the preset location. This control signal is fed into the control boxes 98 which operate the variable speed motors 90 to move the portion of the continuous web 4 in the control station and therefore the solid line section 160 along the vector path 162 and then along the linear path 164 which is parallel to the center line of the cutting and creasing machine 126 until the solid line section 160 is at the correct location **160*c* in the cutting and creasing machine 26. If the solid line station 160 is off-set from the dashed lines section 160 by the amount of 0.125 inch, the vector path 162** will have a linear extent of about 1.25 inches.

It is contemplated that the inventive concepts herein described may be variously otherwise embodied and it is intended that the appended claims be construed to include alternative embodiments of the invention except insofar as limited by the prior art.

What is claimed is:

1. Apparatus for locating a portion of a continuous web of material having graphics printed thereon in a cutting and creasing machine for forming carton blanks comprising:

a cutting and creasing machine, for making cut and fold lines in successive portions of a continuous web of material having graphics printed thereon to form a carton blank, mounted at a fixed location and having a center line;

a control station, through which said continuous web of material passes, located adjacent to said cutting and creasing machine;

a support frame in said control station having a center line at least parallel to said center line of said cutting and creasing machine;

moving means for intermittently moving a portion of said continuous web of material into said control station;

orientation means in said control station for comparing the location of a section of said graphics on said portion of said continuous web of material with a preset location of where said section of graphics should be located and generating a control signal indicating any deviation of said location of said section of graphics from said preset location of said section of graphics;

said moving means also moving said portion of said continuous web of material from said control station into said cutting and creasing machine; and control means operating in response to said control signal to operate said moving means to move said portion of said continuous web of material into a correct location in said cutting and creasing machine so that said section of said graphics is properly located in the formed carton blank.

2. Apparatus as in claim 1 wherein:

said moving means include at least two spaced apart drive rolls and at least two spaced apart idler rolls; and said at least two spaced apart idler rolls applying pressure on said continuous web of material located between said at least two spaced drive rolls and said at least two spaced apart idler rolls.

3. Apparatus as in claim 2 wherein:

each of said at least two spaced apart idler rolls having an axis of rotation that is parallel to the axis of rotation of an associated one of said at least two spaced apart drive rolls; and the axes of rotation of one of said at least two spaced apart drive rolls and its associated one of said at least two spaced apart idler rolls being out of alignment with the axes of rotation of the other one of said at least two spaced apart drive rolls and its associated other one of said at least two spaced apart idler rolls.

4. Apparatus as in claim 3 comprising:

at least two spaced apart variable speed drive means each of which rotates one of said at least two spaced apart drive rolls.

5. Apparatus as in claim 4 and further comprising:

at least two spaced apart mounting plates;

pivot means for pivotally mounting each of said at least two spaced apart mounting plates on said support frame; and each of said at least two spaced apart mounting plates having mounted thereon one of said at least two spaced apart drive rolls, one of said at least two spaced apart idler rolls and one of said at least two variable speed drive means for movement therewith.

6. Apparatus as in claim 5 wherein each of said at least two spaced apart variable speed drive means comprises:

a variable speed motor;

a first rotatable pulley mounted on and rotated by said variable speed motor;

a second rotatable pulley mounted on said drive roll to rotate said drive roll; and a driving belt journaled around said first and second rotatable pulleys rotated by said first rotatable pulley to rotate said second rotatable pulley.

7. Apparatus as in claim 6 and further comprising:

at least two spaced apart support plates;

one of said at least two spaced apart support plates being mounted on one of said at least two spaced apart mounting plates for linear movement relative thereto;

one of said variable speed motors being mounted on each support plate; and adjusting means associated with each support plate for moving said support plate to adjust the tension in said driving belt.

8. Apparatus as in claim 5 and further comprising:

mounting means for mounting said orientation means for movement in directions parallel and perpendicular to said center line of said support frame.

9. Apparatus as in claim 8 wherein:

the included angle between the axis of rotation of one of said at least two spaced apart drive rolls and the axis of rotation of the other of said at least two spaced apart drive rolls in relation to the center line of said support frame in the direction of movement of said continuous web of material being less than 180 degrees.

10. Apparatus as in claim 9 wherein:

the included angle between the axis of rotation of said one of said at least two spaced apart drive rolls and said center line of said support frame in the direction of movement of said continuous web of material being less than 90 degrees; and the included angle between the axis of rotation of said other of said at least two spaced apart drive rolls and said center line of said support frame in the direction of movement of said continuous web of material being less than 90 degrees.

11. Apparatus as in claim 4 and further comprising:

the included angle between the axis of rotation of one of said at least two spaced apart drive rolls and the axis of rotation of the other of said at least two spaced apart drive rolls in relation to said center line of said support frame being less than 180 degrees.

12. Apparatus as in claim 11 wherein:

the included angle between the axis of rotation of said one of said at least two spaced apart drive rolls and said center line of said support frame in the direction of movement of said continuous web of material being less than 90 degrees; and the included angle between the axis of rotation of said other of said at least two spaced apart drive rolls and said center line of said support frame in direction of movement of said continuous web of material being less than 90 degrees.

13. Apparatus as in claim 12 wherein:

said control signal generated by said orientation means comprising the distance that the location of said section of said graphics on said portion of said continuous web of material is off set from said preset location of said section of graphics in directions parallel and perpendicular to said center line of said support frame; and said control means operating said moving means to move said portion of said continuous web of material first along a vector path in an angular relationship relative to said center line of said support frame and then along a parallel path relative to said center line of said support frame into the correct location in said cutting and creasing machine.

14. Apparatus as in claim 13 and further comprising:

mounting means for mounting said orientation means for movement in directions parallel and perpendicular to said center line of said support frame to locate said orientation means at said section of graphics on said continuous web.

15. Apparatus as in claim 1 wherein:

said control signal generated by said orientation means comprising the distance that the location of said section of said graphics on said portion of said continuous web of material is off set from said preset location of said section of graphics in directions parallel and perpendicular to said center line of said support frame; and said control means operating said moving means to move said portion of said continuous web of material first along a vector path in an angular relationship relative to said center line of said support frame and then along a parallel path relative to said center line of said support frame into the correct location in said cutting and creasing machine.

16. A method for moving a portion of a continuous web of material having graphics printed thereon into a cutting and creasing machine having a center line for forming carton blanks from the continuous web of material comprising:

moving a portion of said continuous web of material into a control station having a center line at least parallel to said center line of said cutting and creasing machine, and having orientation means located therein;

comparing the location of a section of said graphics on said portion of said continuous web of material with a preset location of where said section of graphics on said portion of said continuous web of material should be;

generating a control signal indicative of a vector path in an angular relationship relative to said center line of said cutting and creasing machine and a parallel path relative to said center line of said cutting and creasing machine along which said portion of said continuous web of material is to be moved so that said portion of said continuous web of material is positioned at the correct location in said cutting and creasing machine; and moving said portion of said continuous web of material along said vector and parallel paths until said portion of said continuous web of material is at the correct location in said cutting and creasing machine.

17. A method as in claim 16, wherein said web of continuous web of material has a center line, comprising:

applying moving forces on opposite sides of said center line of said continuous web of material to move said portion of said continuous web of material in said direction which includes vector and parallel paths relative to said center lines of said support frame and said cutting and creasing machine.

18. A method as in claim 17 and further comprising:

applying each of said forces to extend along a linear line on each side of said center line; and locating said linear lines so that the included angle between said linear lines in the direction of movement of said continuous web of material is less than 180 degrees.

19. A method as in claim 18 wherein:

locating said linear lines so that the included angles between each of said linear lines and said center line of said continuous web is less than 90 degrees.

20. A method as in claim 19 wherein:

applying a greater amount of force along one of said linear lines than the amount of force applied to the other one of said linear lines.

* * * * *